US006376990B1

(12) United States Patent
Allen et al.

(10) Patent No.: US 6,376,990 B1
(45) Date of Patent: Apr. 23, 2002

(54) LINEAR ACCELERATOR

(75) Inventors: John Allen; Leonard Knowles Brundle, both of Haywards Heath; Terry Arthur Large, Lindfield; Terence Bates, Horsham, all of (GB)

(73) Assignee: Elekta AB, Stockholm (SE)

( * ) Notice: Subject to any disclaimer, the term of this patent is extended or adjusted under 35 U.S.C. 154(b) by 0 days.

(21) Appl. No.: 09/529,757

(22) PCT Filed: Feb. 5, 1999

(86) PCT No.: PCT/GB99/00187

§ 371 Date: Apr. 18, 2000

§ 102(e) Date: Apr. 18, 2000

(87) PCT Pub. No.: WO99/40759

PCT Pub. Date: Aug. 12, 1999

(30) Foreign Application Priority Data

Feb. 5, 1998 (GB) ..... 9802332

(51) Int. Cl.[7] ..... H01J 25/10; H01J 25/34

(52) U.S. Cl. ..... 315/5.41; 315/5.39; 315/505; 315/500; 315/111.61

(58) Field of Search ..... 315/505, 500, 315/111.61, 5.41, 5.39

(56) References Cited

U.S. PATENT DOCUMENTS 4,024,426 A * 5/1977 Vaguine ..... 315/5.41
4,400,650 A * 8/1983 Giebeler ..... 315/5.41

FOREIGN PATENT DOCUMENTS

| | | | |
|---|---|---|---|
| EP | 0196913 | 10/1986 | ..... H05H/9/04 |
| GB | 2081005 | 2/1982 | ..... H05H/7/12 |
| GB | 2081502 | 2/1982 | ..... H05H/9/04 |

OTHER PUBLICATIONS

Tanabe E et al., "Compact multi–energy electron linear accelerators", Proceedings of the 8th conference on the Application of Accelerators in Research and Industry, Denton, TX, USA, Nov. 12–14, 1984, vol. B10–11, pt.2, pp. 871–876 vol. 2, XP002103628, ISSN 016–583X, Nuclear Instruments & Methods in Physics Research, Section B (Beam Interactions with Materials and Atoms), May 15, 1985, Netherlands.

* cited by examiner

*Primary Examiner*—Jack Berman
*Assistant Examiner*—Nikita Wells
(74) *Attorney, Agent, or Firm*—Kinney & Lange, P.A.

(57) ABSTRACT

This device allows the variation of the coupling between two points in an RF circuit in a very simple way while maintaining the RF phase relationship and varying the relative magnitude of the RF fields. The device is characterized by a simple mechanical control of coupling value, that has negligible effect on the phase shift across the device. This is achieved by the simple rotation of the polarisation of a $TE_{111}$ mode inside a cylindrical cavity. Such a device does not contain resistive elements, and the sliding mechanical surfaces are free from high RF currents. This device finds an application in standing wave linear accelerators, where it is desirable to vary the relative RF field in one set of cavities with respect to another, in order that the accelerator can operate successfully over a wide range of energies.

12 Claims, 12 Drawing Sheets

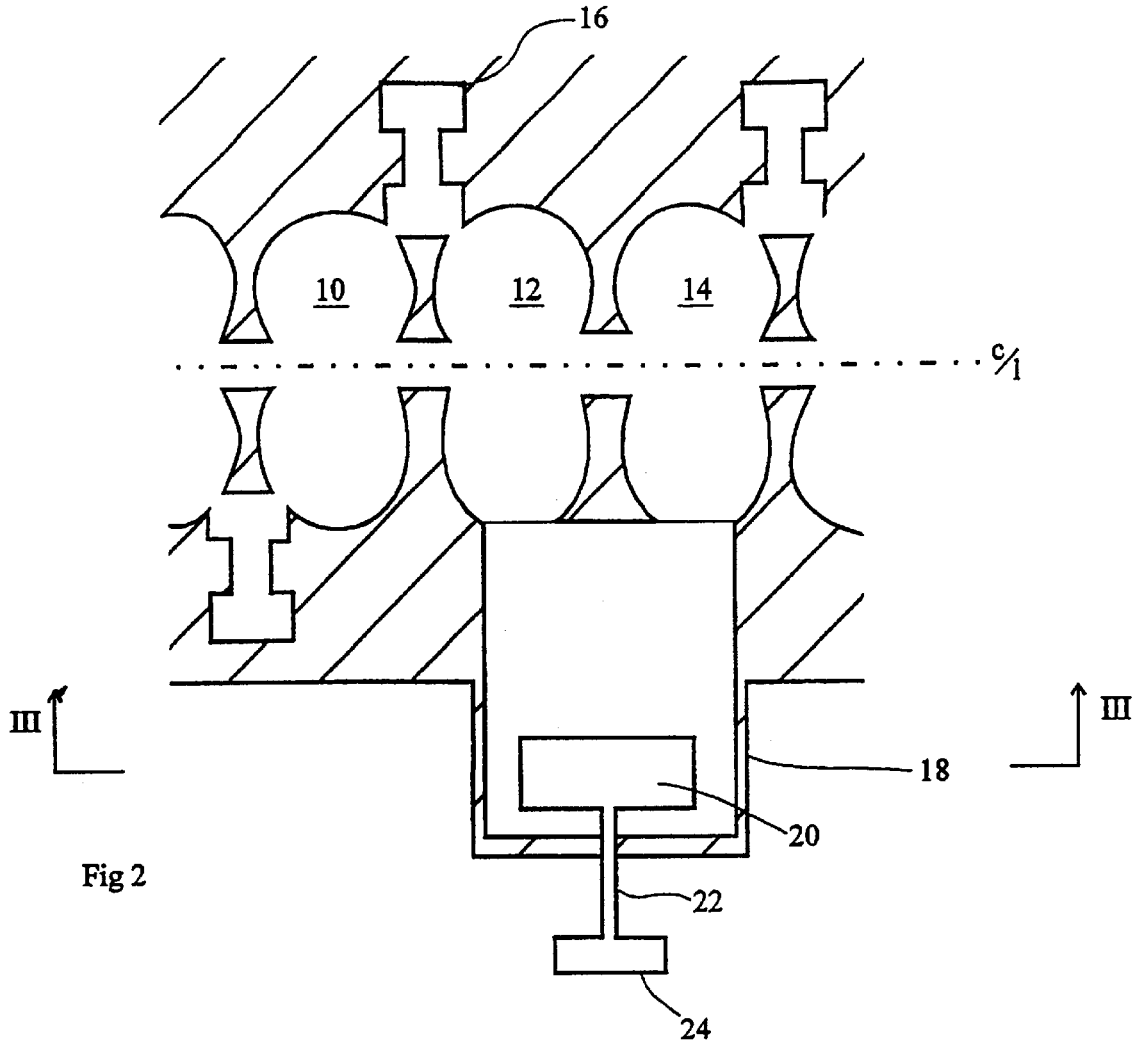
Fig 2
Fig 3
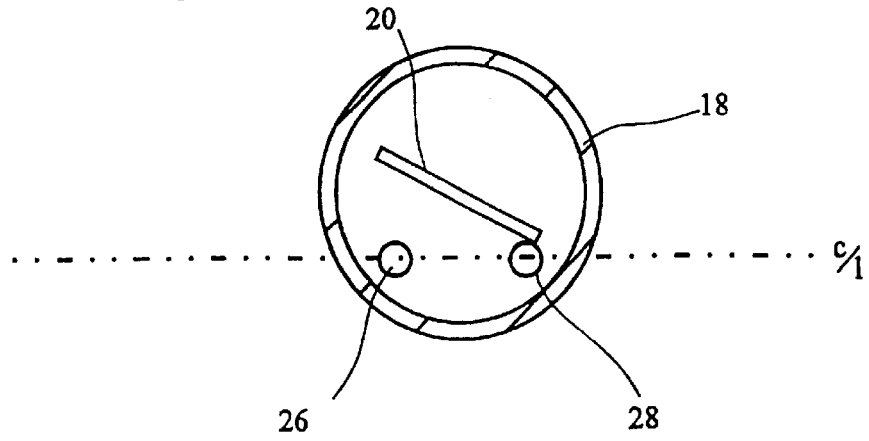

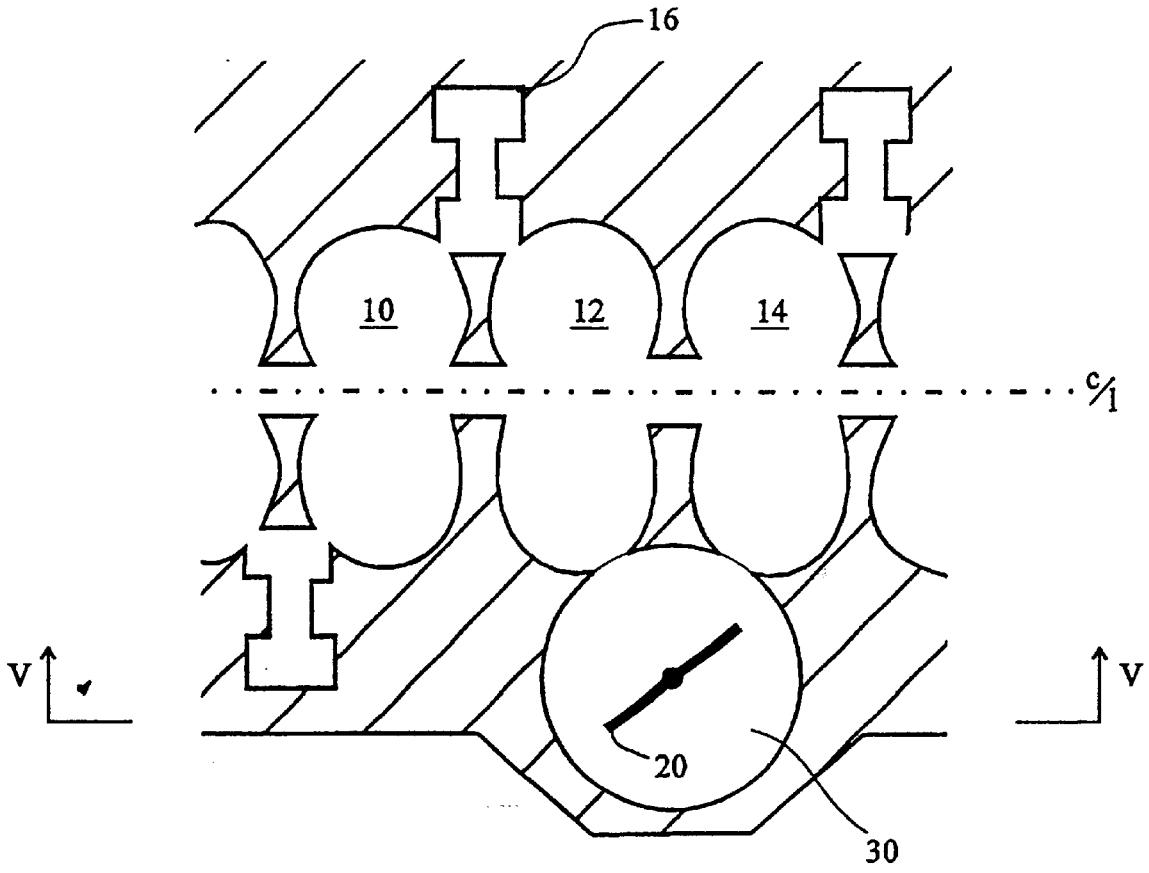
Fig 4
Fig 5
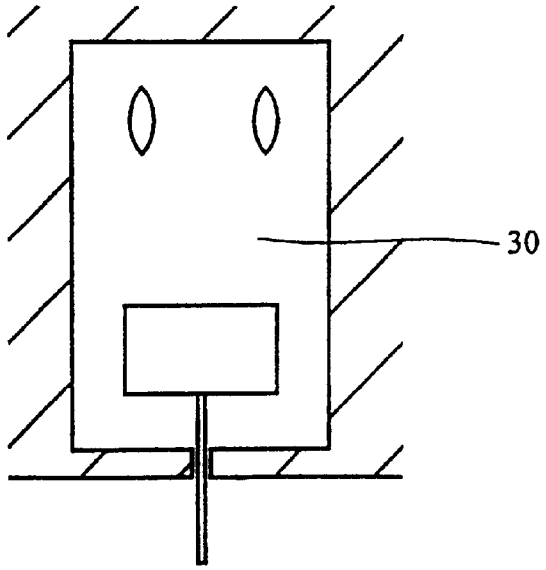

LINEAR ACCELERATOR

BACKGROUND FIELD OF THE INVENTION

The present invention relates to a linear accelerator.

BACKGROUND ART

Linear accelerators, particularly of the standing wave design, are known as a source of an electron beam, for example for use in X-Ray generation. This beam can be directed to an X-ray target which then produces suitable radiation. A common use for such X-rays or for the electron beam is in the medical treatment of cancers etc.

It is often necessary to vary the incident energy of the electron beam on the X-ray target. This is particularly the case in medical applications where a particular energy may be called for by the treatment profile. Linear standing wave accelerators comprise a series of accelerating cavities which are coupled by way of coupling cavities which communicate with an adjacent pair of accelerating cavities. According to U.S. Pat. No. 4,382,208, the energy of the electron beam is varied by adjusting the extent of rf coupling between adjacent accelerating cavities. This is normally achieved by varying the geometrical shape of the coupling cavity.

This variation of the geometrical shape is typically by use of sliding elements which can be inserted into the coupling cavity in one or more positions, thereby changing the internal shape of the cavity. There are a number of serious difficulties with this approach arising from the various other resonant parameters that are dictated by the cavity dimensions. Often more than one such element has to be moved in order to preserve the phase shift between cavities at a precisely defined value. The movement of the elements is not usually identical, so they have to be moved independently, yet be positioned relative to each other and the cavity to very great accuracy in order that the desired phase relationship is maintained. Accuracies of ±0.2 mm are usually required. This demands a complex and high-precision positioning system which is difficult to engineer in practice. In those schemes which have less than two moving parts (such as that proposed in U.S. Pat. No. 4,286,192), the device fails to maintain a constant phase between input and output, making such a device unable to vary RF fields continuously, and are thus reduced to the functionality of a simple switch. They are in fact often referred to as an energy switch.

Many of these schemes also propose sliding contacts which must carry large amplitude RF currents. Such contacts are prone to failure by weld induced seizure, and the sliding surfaces are detrimental to the quality of an ultra high vacuum system. Issues of this nature are key to making a device which can operate reliably over a long lifetime.

The nature of previous proposed solutions can be summarised as cavity coupling devices with one input and one output hole, the whole assembly acting electrically like a transformer. To achieve variable coupling values the shape of the cavity has had to be changed in some way, by means of devices such as bellows, chokes and plungers. However the prior art does not offer any device which can vary the magnitude of the coupling continuously over a wide range by means of a single axis control, while simultaneously maintaining the phase at a constant value.

The present state of the art is therefore that such designs are accepted as providing a useful way of switching between two predetermined energies. However, it is very difficult to obtain a reliable accelerator using such designs that offers a truly variable energy output.

A good summary of the prior art can be found in U.S. Pat. No. 4,746,839.

SUMMARY OF THE INVENTION

The present invention therefore provides a standing wave linear accelerator, comprising a plurality of resonant cavities located along a particle beam axis, at least one pair of resonant cavities being electromagnetically coupled via a coupling cavity, the coupling cavity being substantially rotationally symmetric about its axis, but including a non-rotationally symmetric element adapted to break that symmetry, the element being rotatable within the coupling cavity, that rotation being substantially parallel to the axis of symmetry of the coupling cavity.

In such an apparatus, a resonance can be set up in the coupling cavity which is of a transverse nature to that within the accelerating cavities. It is normal to employ a TM mode of resonance with the accelerating cavities, meaning that a TE mode, such as $TE_{111}$, can be set up in the coupling cavity. Because the cavity is substantially rotationally symmetric, the orientation of that field is not determined by the cavity. It is instead fixed by the rotational element. Communication between the coupling cavity and the two accelerating cavities can then be at two points within the surface of the coupling cavity, which will "see" a different magnetic field depending on the orientation of the TE standing wave. Thus, the extent of coupling is varied by the simple expedient of rotating the rotational element.

Rotating an element within a vacuum cavity is a well known art and many methods exist to do so. This will not therefore present a serious engineering difficulty. Furthermore, eddy currents will be confined to the rotational element itself and will not generally need to bridge the element and its surrounding structure. Welds will not therefore present a difficulty.

The design is also resilient to engineering tolerances. Preliminary tests show that an accuracy of only 2 dB is needed in order to obtain a phase stability of 2% over a 40° coupling range. Such a rotational accuracy is not difficult to obtain.

It is preferred if the rotational element is freely rotatable within a coupling cavity of unlimited rotational symmetry. This arrangement gives an apparatus which offers greatest flexibility.

A suitable rotational element is a paddle disposed along the axis of symmetry. It should preferably be between a half and three quarters of the cavity width, and is suitably approximately two-thirds of the cavity width. Within these limits, edge interactions between the paddle and the cavity surfaces are minimised.

The axis of the resonant cavity is preferably transverse to the particle beam axis. This simplifies the rf interaction considerably.

The accelerating cavities preferably communicate via ports set on a surface of the coupling cavity. It is particularly preferred if the ports lie on radii separated by between 40° and 140°. A more preferred range is between 60° and 120°. A particularly preferred range is between 80 and 100°, i.e. approximately 90°.

The ports can lie on an end face of the cavity, i.e. one transverse to the axis of symmetry, or on a cylindrical face thereof. The latter is likely to give a more compact arrangement, and may offer greater coupling.

Thus, the invention proposes the novel approach of coupling adjacent cells via a special cavity operating in a TE mode, particularly the $TE_{111}$ mode. By choosing the coupling positions of the input and output holes to lie along a chord of the circle forming one of the end walls of the cavity, a special feature of the $TE_{111}$ mode can be exploited to realise a coupling device with unique advantages. Instead of changing the shape of the cavity, this invention proposes to rotate the polarisation of $TE_{111}$ mode inside the cavity by means of a simple paddle. Because the frequency of the $TE_{111}$ mode does not depend upon the angle that the field pattern makes with respect to the cavity (the polarising angle), the relative phase of RF coupled into two points is invariant with respect to this rotation, at least over 180°. At the same time, the relative magnitude of the RF magnetic fields at the two coupling holes lying along a chord varies by up to two orders of magnitude. This property of the RF magnetic field is the basis of the variable RF coupler of this invention.

The key to the proposed device is that the moving paddle is not a device to change the shape of the cavity, as described in the prior art, but is merely a device to break circular symmetry of the cylindrical cavity. As such the paddle does not have to make contact with the walls of the cavity, nor does any net RF current flow between the paddle and the cavity wall. This makes the device simple to construct in vacuum, requiring only a rotating feed-through, which is well known technology. Alternatively, the paddle might be rotated by an external magnetic field, and so eliminate the vacuum feed-through requirements entirely.

BRIEF DESCRIPTION OF THE DRAWINGS

Embodiments of the present invention will now be described by way of example, with reference to the accompanying drawings, in which:

FIG. 2 shows a longitudinal cross-section through a standing wave linear accelerator according to a first embodiment of the present invention;

FIG. 3 shows a section on III—III of FIG. 2;

FIG. 4 is a longitudinal cross-section through a standing wave linear accelerator according to a second embodiment of the present invention;

FIG. 5 is a section on V—V of FIG. 4;

DETAILED DESCRIPTION OF THE EXAMPLES

Figure 1:
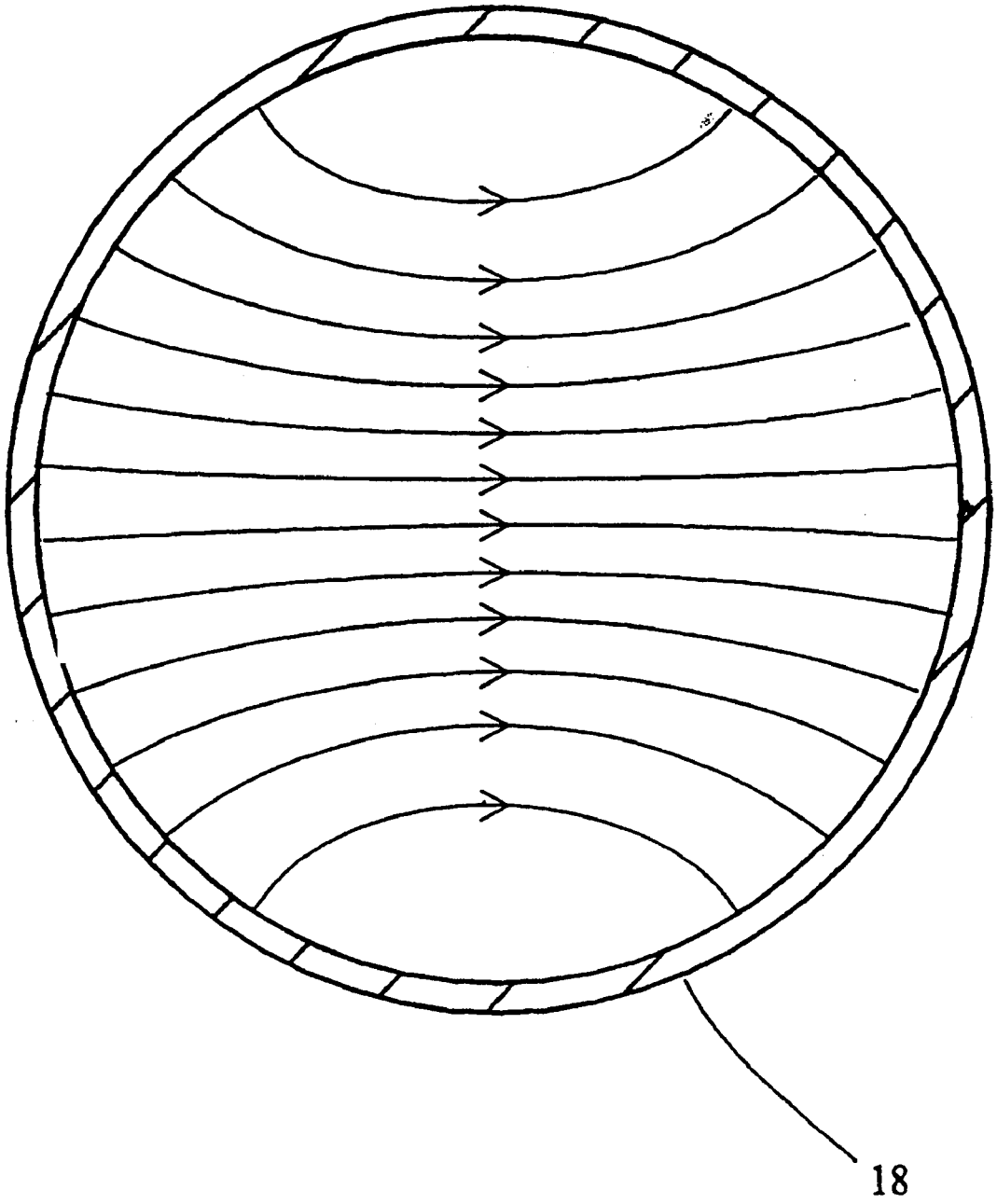
FIG. 1 is a view of the electric field lines of the $TE_{111}$ cylindrical cavity mode.

In a standing wave accelerator the device could be implemented as shown in the first embodiment, FIGS. 2 and 3. These show three on-axis accelerating cells 10, 12, 14 as part of a longer chain of cavities. The first and second accelerating cavities 10, 12 are coupled together with a fixed geometry coupling cell 16, which is known art. Between the second and third on-axis cavities 12, 14, the fixed geometry cell is replaced by a cell 18 according to the present invention. This cell 18 is formed by the intersection of a cylinder with the tops of the arches that make up the accelerating cells thus forming two odd shaped coupling holes 26, 28. To function as intended, these holes should ideally be along a (non-diametrical) chord of the off-axis cylinder, which implies that the center line of the cylinder is offset from the center line of the accelerator, as shown in the FIG. 3. These coupling holes are in region of the cavity where magnetic field dominates, and so the coupling between cells is magnetic. However unlike the fixed geometry cells there is now a simple means of varying the coupling between cells, and consequently the ratio of the RF electric field in the second and third on-axis cells. The strength of the coupling (k) depends upon the shape of the hole and the local value of the RF magnetic field at the position of the hole. The on-axis electric field varies inversely with the ratio of the k values. Hence:

$$E_1/E_2=k_2/k_1$$

The magnetic field pattern close to the end wall means that if the coupling holes lie along a chord, $k_1$ will increase as $k_2$ decreases.

A rotatable paddle 20 is held within the cavity 18 by an axle 22 which in turn extends outside the cylindrical cavity 18. As shown in FIG. 2, the axle has a handle 24 to permit rotation of the paddle 20, but the handle could obviously be replaced by a suitable actuator.

The paddle serves to break the symmetry of the cavity 18, thus forcing the electric lines of field to lie perpendicular to the paddle surface.

The end result is a device which has just one simple moving part, which upon rotation will provide a direct control of the coupling between cells, while at the same time keeping the relative phase shift between input and output fixed, say at a nominal $\pi$ radians. The only degree of freedom in the system is the angle of rotation of the paddle. In a typical standing wave accelerator application this would only have to be positioned to the accuracy of a few degrees. Such a control would allow the energy of a linear accelerator to be adjusted continuously over a wide range of energy.

According to the second embodiment, shown in FIGS. 4 and 5, the coupling cavity 30 is still transverse to the longitudinal axis of the accelerating cavities, but intersects with accelerating cavities 12, 14 along a cylindrical face thereof. Thus, the axes of the accelerator and of the coupling cavity do not intersect, but extend in directions which are mutually transverse. The paddle 20 etc. is unchanged. Otherwise, the operation of this embodiment is the same as the first.

FIGS. 6–10 illustrate a third embodiment of the present invention. In the Figures, a short sub-element of a linear accelerator is illustrated, consisting of two accelerating cavities and the halves of two coupling cavities either side. In addition, the element includes a single coupling cavity embodying the present invention, joining the two accelerating cavities. A complete accelerator would be made up of several such sub-elements joined axially.

Figure 6:
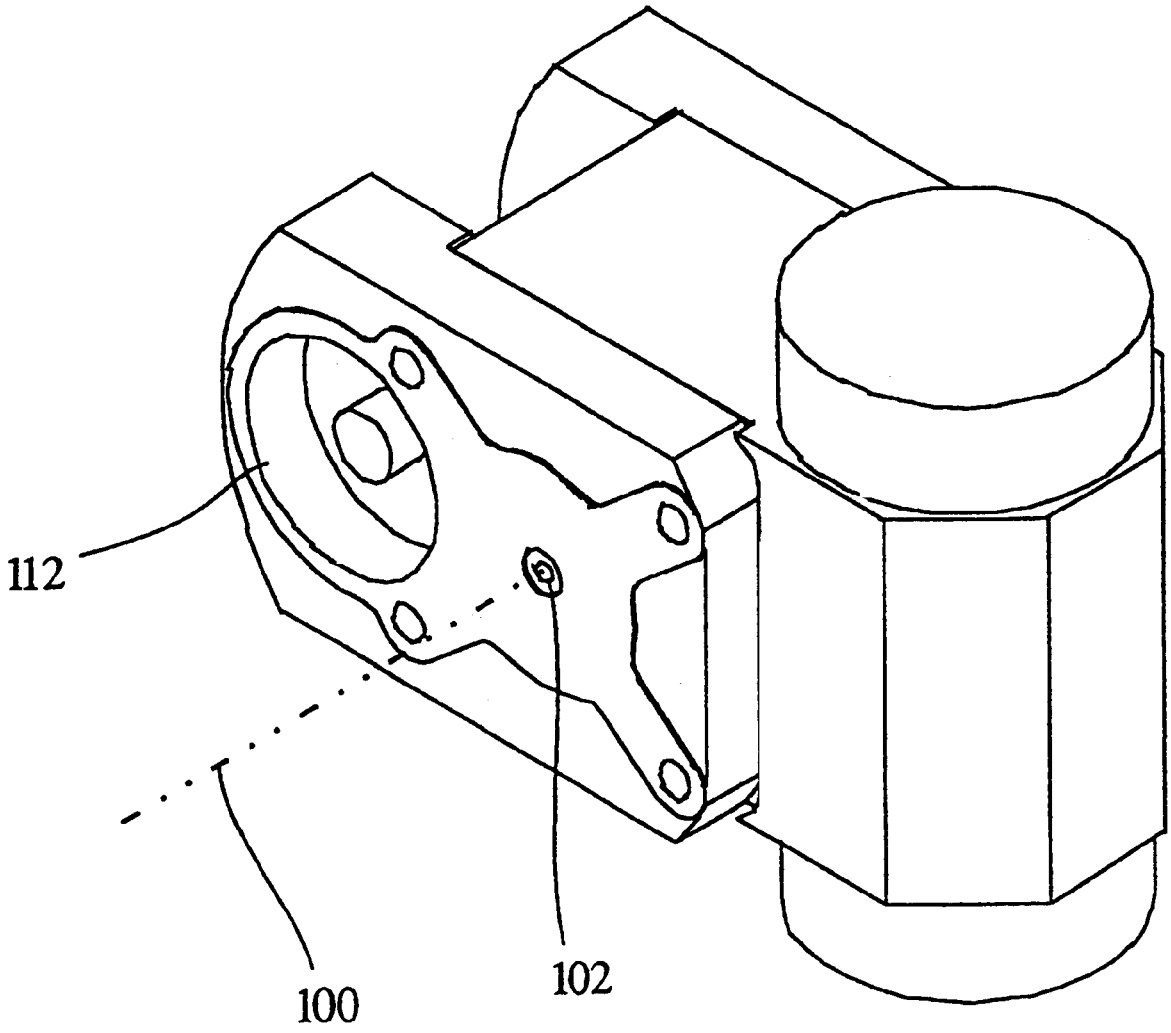
FIG. 6 is a perspective view of an accelerator element of a third embodiment of the present invention.
Figure 7:
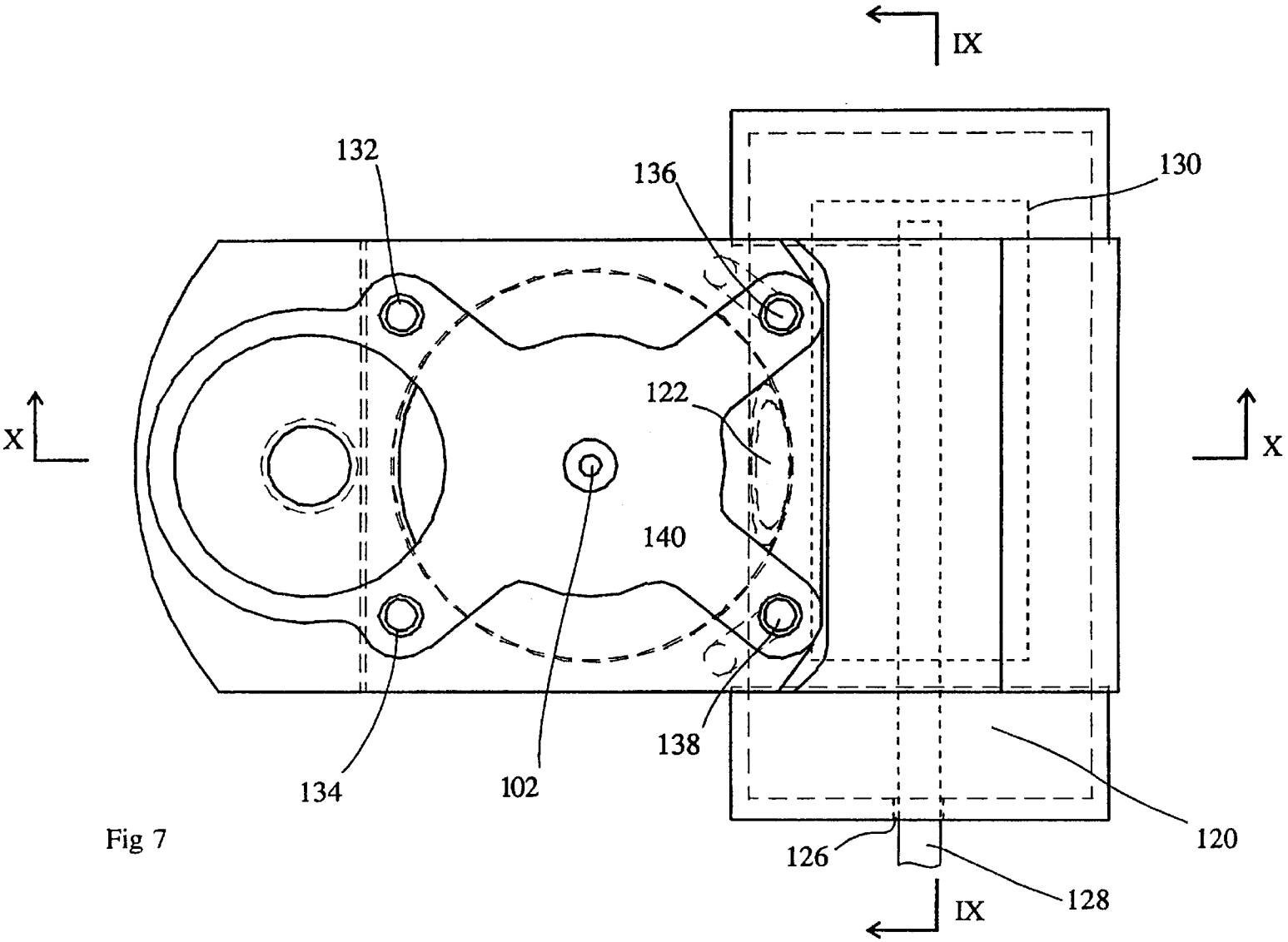
FIG. 7 is an axial view of the embodiment of FIG. 6.

In FIG. 6, the axis 100 of the accelerating cavities passes into a small opening 102 into a first coupling cavity 104 (not visible in FIG. 6). A further accelerating cavity 108 communicates with the first accelerating cavity 104 via an aperture 106. The second cavity 108 then has a further aperture 110 on its opposing side to communicate with subsequent accelerating cavities formed when the sub-element of this embodiment is repeated along the axis 100.

Thus, a beam being accelerated passes in order through apertures 102, 106, 110 etc.

A pair of coupling half-cavities are formed in the illustrated sub-element. The first half cavity 112 provides a fixed magnitude coupling between the first accelerating cavity 104 and an adjacent accelerating cavity formed by an adjacent sub-element. This adjacent sub-element will provide the remaining half of the coupling cavity 112. Likewise, the second coupling cavity 114 couples the second accelerating 108 to an adjacent cavity provided by an adjacent element. Each coupling cavity includes an upstanding post 116, 118 which tunes that cavity to provide the appropriate level of coupling desired. The coupling cavities 112, 114 are conventional in their construction.

The first accelerating cavity 104 is coupled to the second accelerating cavity 108 via an adjustable coupling cavity 120. This consists of a cylindrical space within the element, the axis of the cylinder being transverse to the accelerator axis 100 and spaced therefrom. The spacing between the two axes at their closest point and the radius of the cylinder is adjusted so that the cylinder intersects the accelerating cavities 104, 108, resulting in apertures 122, 124. As illustrated in this embodiment, the cylinder 120 is positioned slightly closer to the second accelerating cavity 108, making the aperture 124 larger than the aperture 122. Depending on the design of the remainder of the accelerator, this may in certain circumstances be beneficial. However, it is not essential and in other designs may be less desirable.

At one end of the adjustable coupling cavity 120, an aperture 126 is formed to allow a shaft 128 to pass into the interior of the cavity. The shaft 128 is rotatably sealed in the aperture 126 according to known methods. Within the adjustable cavity 120, the shaft 128 supports a paddle 130 which is therefore rotationally positionable so as to define the orientation of a $TE_{111}$ field within the adjustable coupling cavity 120 and thus dictate the amount of coupling between the first cavity 104 and the second cavity 108.

Cooling channels are formed within the element to allow water to be conducted through the entire construction. In this example, a total of four cooling channels are provided, equally spaced about the accelerating cavities. Two cooling channels 132, 134 run above and below the fixed coupling cavities 112, 114 and pass straight through the unit. Two further coupling cavities 136, 138 run along the same side as the variable cavity 120. To prevent the cooling channels conflicting with the accelerating cavities 104, 108 or the adjustable coupling cavity 120, a pair of dog legs 140 are formed, as most clearly seen in FIGS. 7 and 8.

Figure 8:
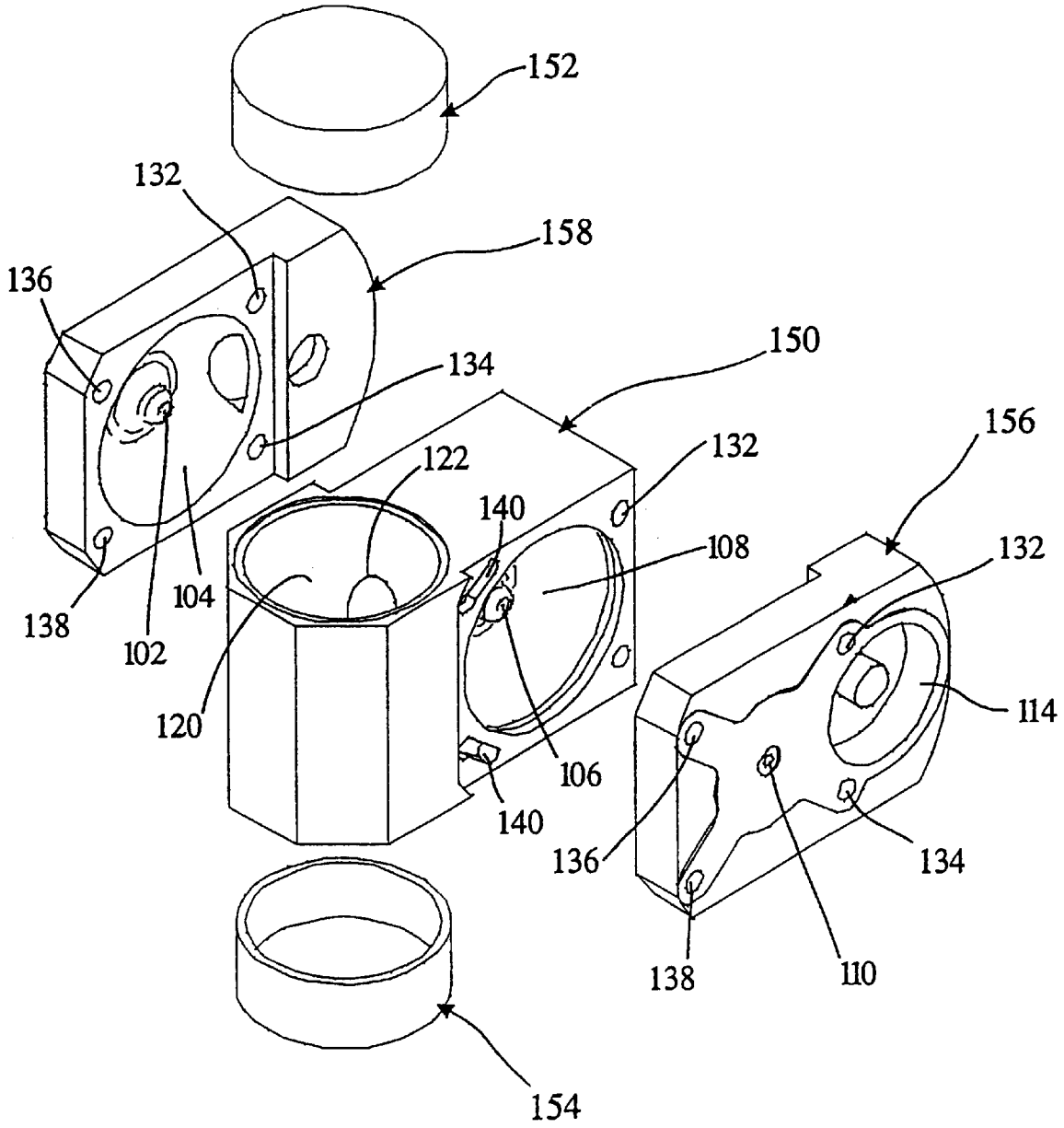
FIG. 8 is an exploded view of the embodiment of FIG. 6.
Figure 9:
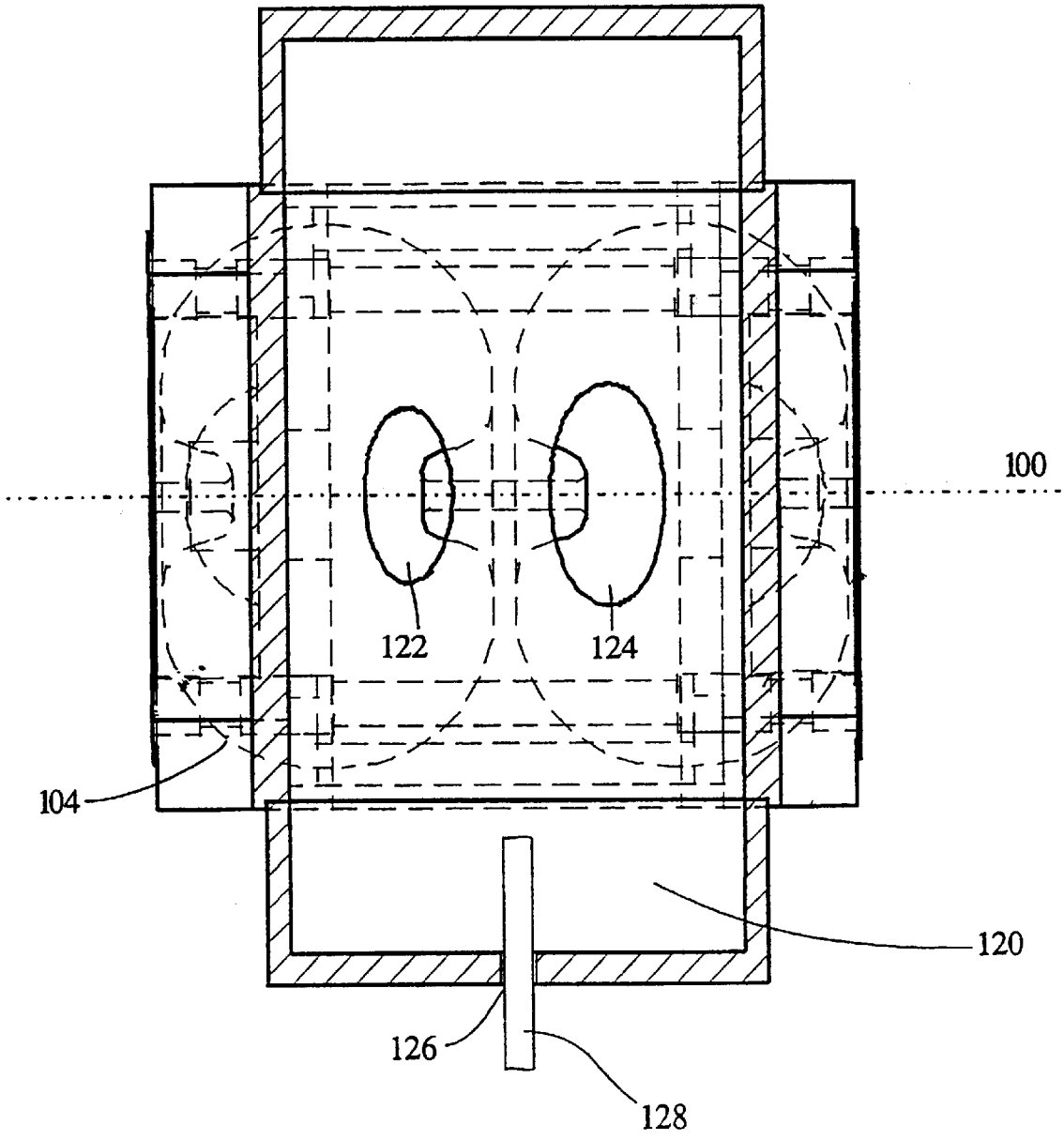
FIG. 9 is a section on IX—IX of FIG. 7.
Figure 10:
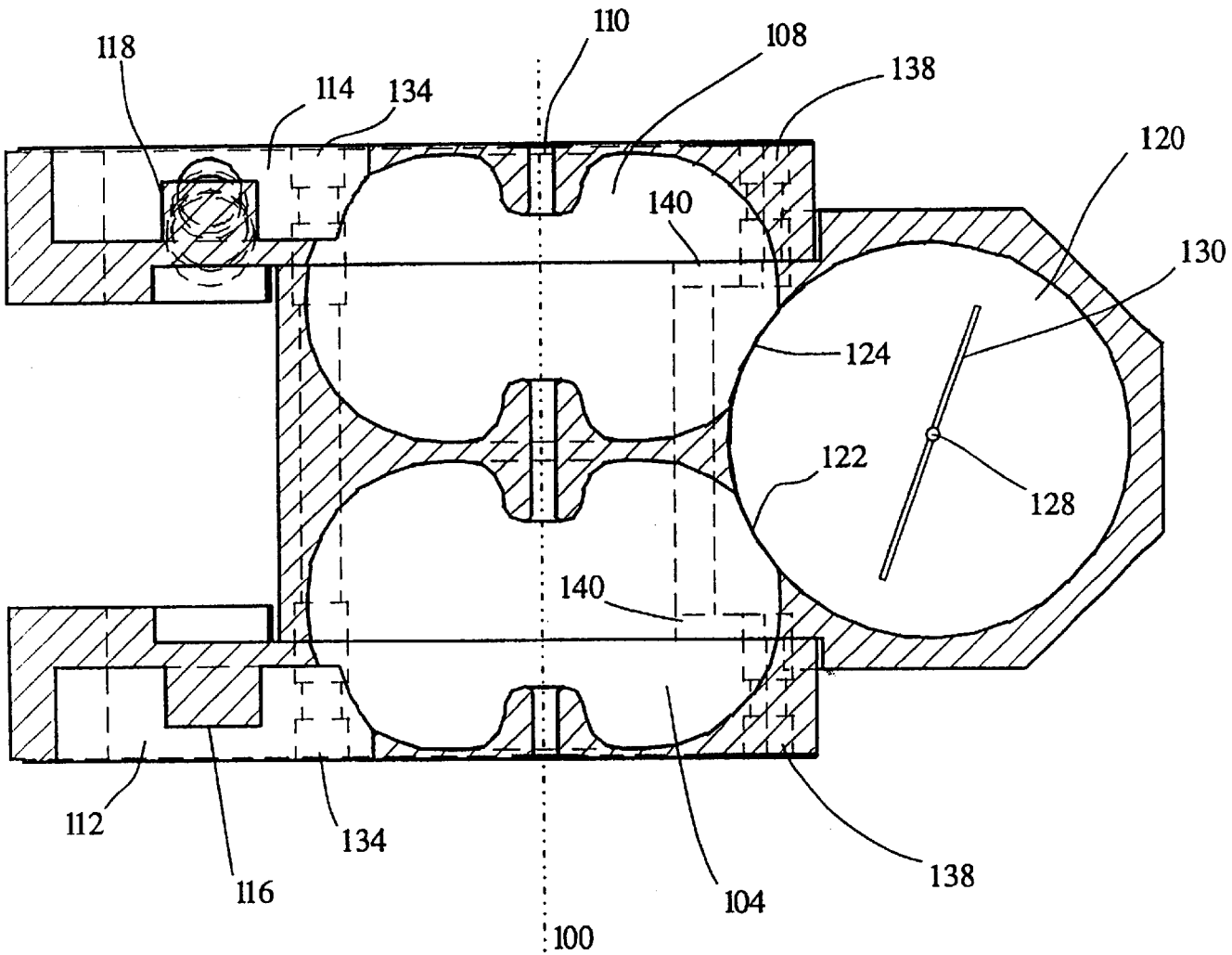
FIG. 10 is a section on X—X of FIG. 7.
Figure 11:
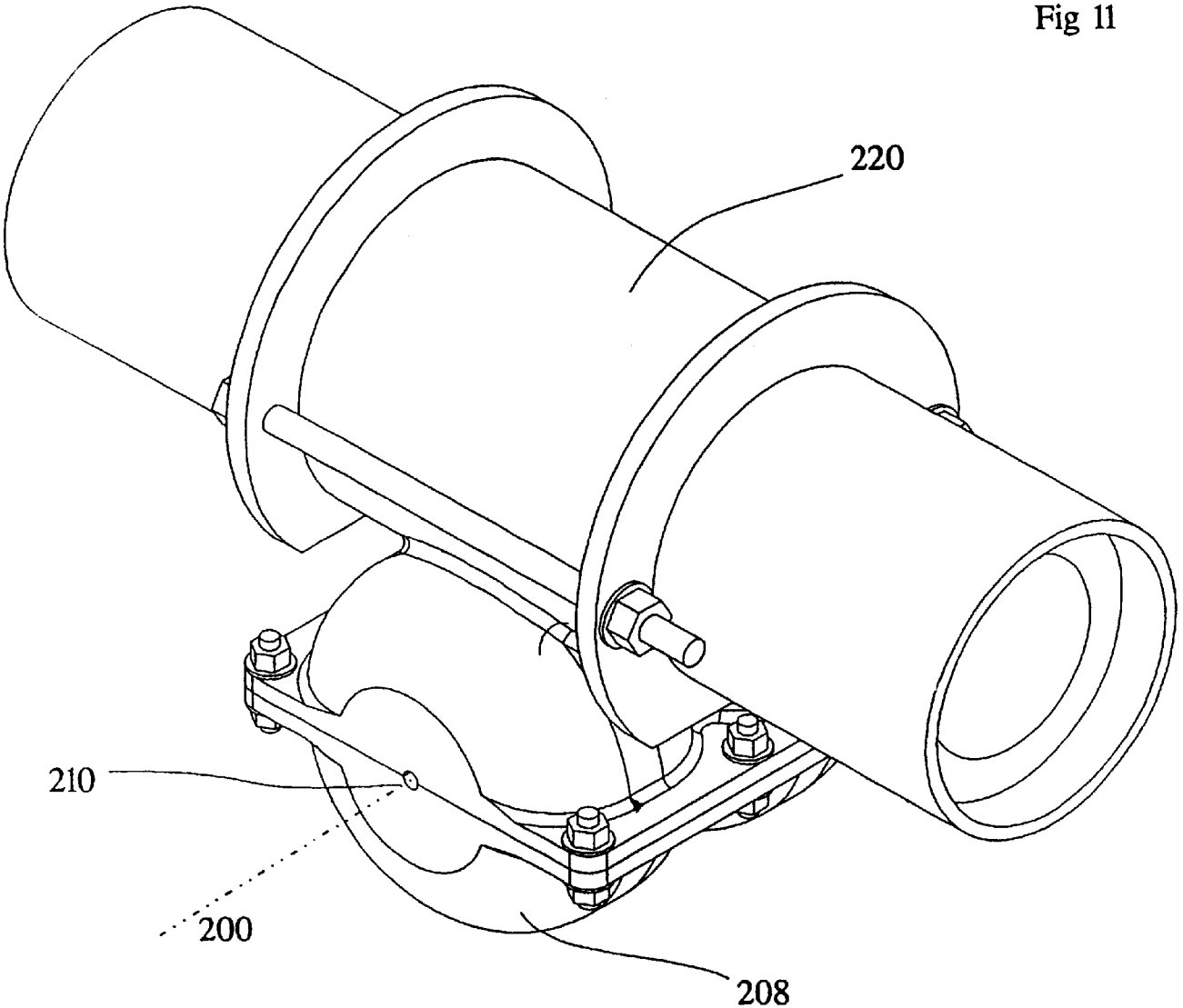
FIG. 11 is a perspective view of a fourth embodiment of the present invention.
Figure 12:
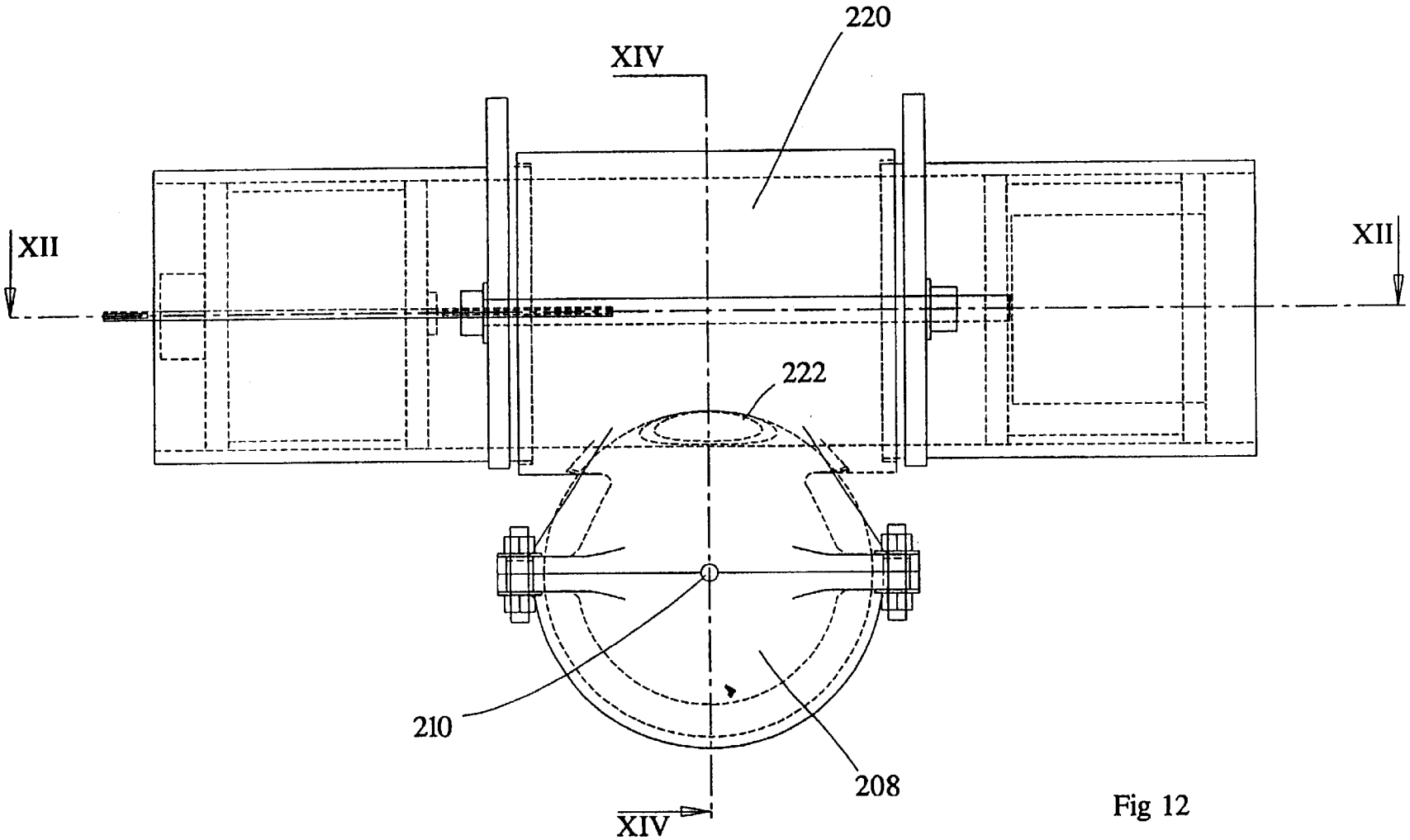
FIG. 12 is a view of the embodiment of FIG. 11 along the accelerator axis.
Figure 13:
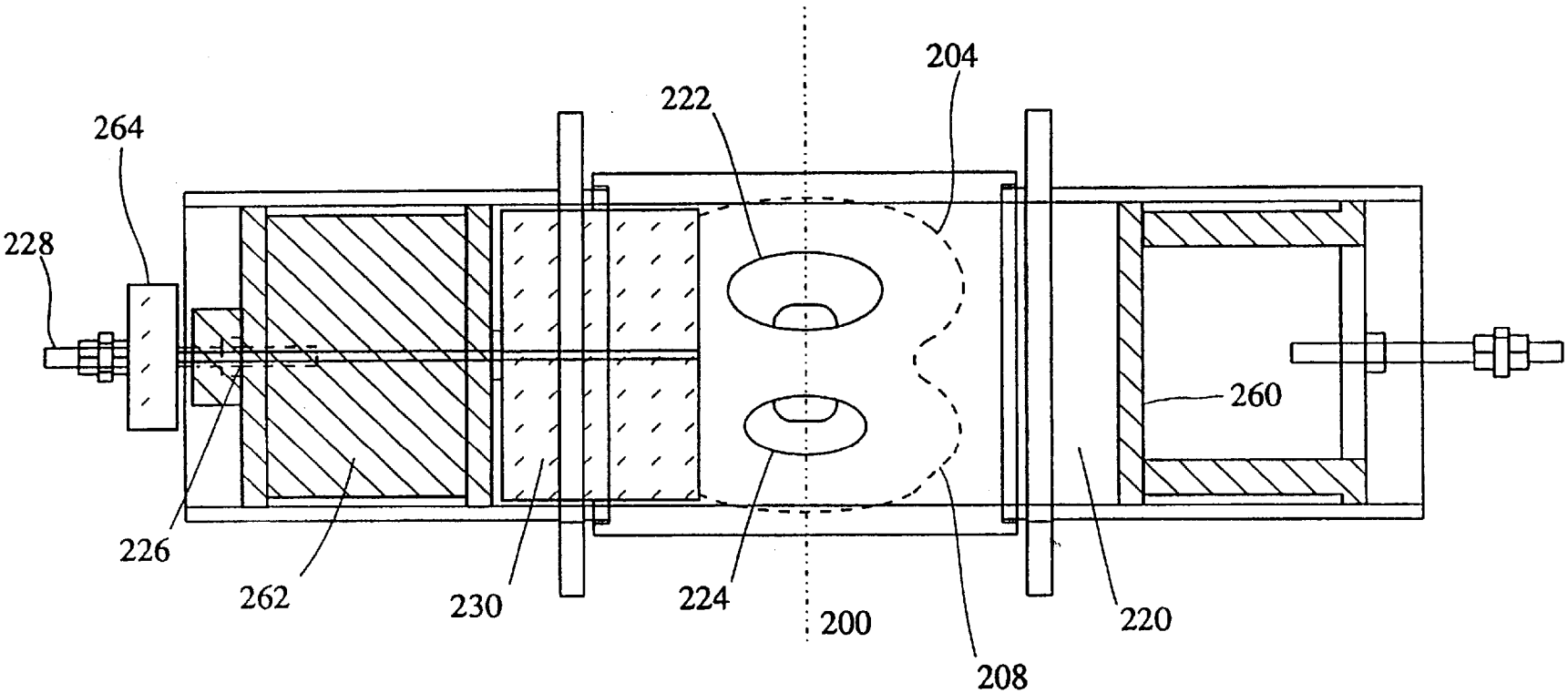
FIG. 13 is a section on XIII—XIII of FIG. 12.
Figure 14:
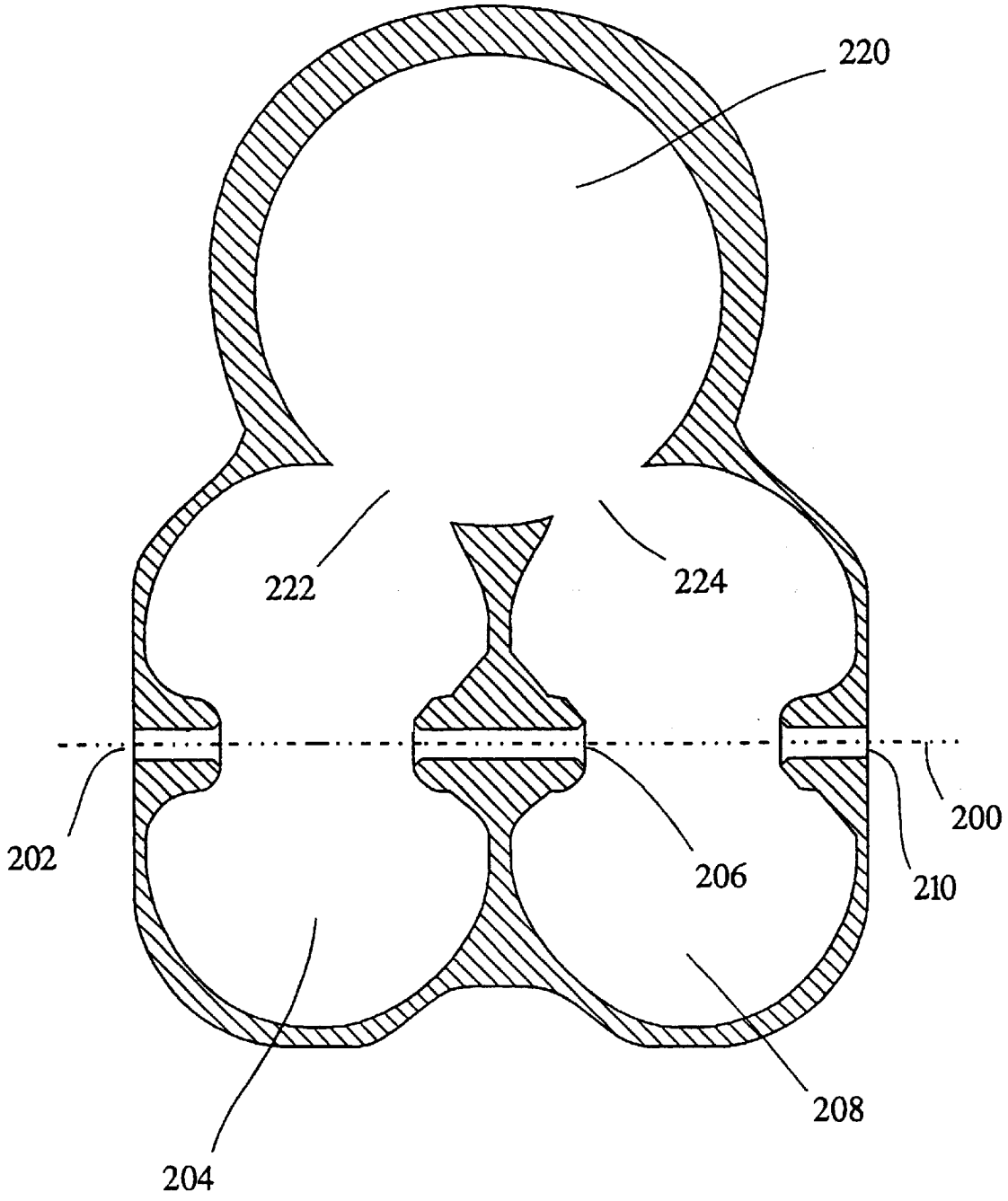
FIG. 14 is a section of XIV—XIV of FIG. 12.

FIG. 8 shows an exploded view of the example illustrating the manner in which it can constructed. A central base unit 150 contains the coupling cavity and two halves of the first and second accelerating cavities 104, 108. The two accelerating cavities can be formed by a suitable turning operation on a copper substrate, following which the central communication aperture 106 between the two cavities can be drilled out, along with the coolant channels 132, 134, 136, 138 and the dog leg 140 of the channels 136 and 138. The adjustable coupling cavity 120 can then be drilled out, thereby forming the apertures 122 and 124 between that cavity and the two accelerating cavities 104, 108. Caps 152, 154 can then be brazed onto top and bottom ends of the adjustable coupling cavity 120, sealing it.

End pieces 156, 158 can then be formed for attachment either side of the central unit 150 by a brazing step. Again, the remaining halves of the coupling cavities 104, 108 can be turned within these units, as can the half cavities 112, 114. Coolant channels 132, 134, 136 and 138 can be drilled, as can the axial communication apertures 102, 110. The end pieces can then be brazed in place either side of the central unit, sealing the accelerating cavities and forming a single unit.

A plurality of like units can then be brazed end to end to form an accelerating chain of cavities. Adjacent pairs of accelerating cavities will be coupled via fixed coupling cavities, and each member of such pairs will be coupled to a member of the adjacent pair via an adjustable coupling cavity 120.

The brazing of such units is well known and simply involves clamping each part together with a foil of suitable eutectic brazing alloy therebetween, and heating the assembly to a suitable elevated temperature. After cooling, the adjacent cavities are firmly joined.

FIGS. 11–14 illustrate a fourth example of the present invention. As with the third example, this example illustrates a sub-element of a linear accelerator containing two accelerating cavities. A plurality of sub-element as illustrated can be joined end to end to produce a working accelerator.

A pair of accelerating cells 204, 208 are aligned along an acceleration axis 200. An aperture 202 allows an accelerating beam to enter the accelerating cavity 204 from an adjacent element, while an aperture 206 allows the beam to continue into accelerating cavity 208, and an aperture 210 allows the beam to continue on the axis 200 out of the accelerating cavity 208 into a further cavity.

An adjustable coupling cavity 220 is formed, interconnecting the two cavities 204 and 208. This adjustable coupling cavity 220 consists of a cylinder whose axis is transverse to the accelerator axis 200 and spaced therefrom. The radius of the cylinder and the positioning of the axis are such that it intersects with the accelerating cavities 204, 208, thereby forming communication apertures 222, 224. As illustrated, the adjustable coupling cavity 220 is positioned more closely to the accelerating cavity 204, and therefore the aperture 222 is slightly larger than the aperture 224. However, this is not essential in all circumstances and depends on the construction of the remainder of the accelerator.

The cylinder forming the adjustable coupling cavity 220 has end faces 260, 262 which are linearly adjustable along the axis of the cylinder 220. Thus, the length of the coupling cavity can be varied in order to match the external design of the accelerator. This length needs to be set according to the resonant frequency of the accelerator. However, experimental work shows that the setting does not need to be especially precise.

The end wall 262 includes an axial aperture 226, through which passes an axle 228. A handle 264 is formed on the outside of the wall 262, and a paddle 230 is formed on the inner face. That paddle serves to break the rotational symmetry of the adjustable coupling cavity 220 and thereby fix the orientation of the $TE_{111}$ field. Thus, the orientation of the field, and hence the magnitude of coupling, can be varied by adjusting the handle 264. Clearly a suitable mechanical actuator could be employed instead of a manually adjustable handle.

It has been found that adjustable coupling cavities such as those described in the third and fourth embodiments are capable of providing a coupling co-efficient between the two accelerating cavities of between 0 and 6%. Most designs of accelerator require a coupling co-efficient of up to 4%, and therefore this design is capable of providing the necessary level of coupling for substantially all situations.

Through the present invention, a continuous range of coupling constants can be obtained without disrupting the phase shift between accelerating cavities. Furthermore, the third embodiment allows a viable accelerator to be constructed from easily manufactured elements.

It will of course be appreciated by those skilled in the art that the above-described embodiment is simply illustrative of the present invention, and that many variations could be made thereto.

What is claimed is:

1. A standing wave linear accelerator, comprising a plurality of resonant cavities located along a particle beam axis, at least one pair of resonant cavities being electromagnetically coupled via a coupling cavity, the coupling cavity being substantially rotationally symmetric about its axis, but including a non-rotationally symmetric element adapted to break that symmetry, the element being rotatable within the coupling cavity, that rotation being substantially parallel to the axis of symmetry of the coupling cavity.

2. An accelerator according to claim 1 in which communication between the coupling cavity and the two accelerating cavities is respectively at two points within the surface of the coupling cavity.

3. An accelerator according to claim 1 wherein the rotational element is freely rotatable within a coupling cavity of unlimited rotational symmetry.

4. An accelerator according to claim 1, in which the rotational element is a paddle disposed along the axis of symmetry.

5. An accelerator according to claim 4 wherein the paddle occupies between a half and three quarters of the cavity width.

6. An accelerator according to claim 1, wherein the axis of the resonant cavity is transverse to the particle beam axis.

7. An accelerator according to claim 1, wherein the accelerating cavities communicate via ports set on a surface of the coupling cavity.

8. An accelerator according to claim 1, wherein the ports lie on radii of the coupling cavity separated by between 40° and 140°.

9. An accelerator according to claim 1, wherein the ports lie on radii of the coupling cavity separated by between 60° and 120°.

10. An accelerator according to claim 1, wherein the ports lie on radii of the coupling cavity separated by between 80° and 100°.

11. An accelerator according to claim 1, wherein the ports lie on an end face of the cavity.

12. An accelerator according to claim 1, wherein the ports lie on a cylindrical face of the cavity.

* * * * *